United States Patent [19]

Thompson

[11] Patent Number: 4,799,065

[45] Date of Patent: Jan. 17, 1989

[54] RECONFIGURABLE BEAM ANTENNA

[75] Inventor: James D. Thompson, Manhattan Beach, Calif.

[73] Assignee: Hughes Aircraft Company, Los Angeles, Calif.

[21] Appl. No.: 885,981

[22] Filed: Jul. 15, 1986

Related U.S. Application Data

[63] Continuation-in-part of Ser. No. 476,087, Mar. 17, 1983, abandoned.

[51] Int. Cl.[4] ..... H01Q 3/26

[52] U.S. Cl. ..... 343/779; 343/853; 342/372

[58] Field of Search ..... 343/779, 853, 854; 342/371, 372, 373

[56] References Cited

U.S. PATENT DOCUMENTS

| | | | |
|---|---|---|---|
| 3,707,719 | 12/1972 | Mark | 343/854 |
| 4,041,501 | 8/1977 | Frazita et al. | 342/373 |
| 4,231,040 | 10/1980 | Walker | 342/373 |
| 4,315,262 | 2/1982 | Acampora | 342/372 |
| 4,471,361 | 9/1984 | Profera, Jr. et al. | 343/853 |

*Primary Examiner*—William L. Sikes
*Assistant Examiner*—Doris J. Johnson
*Attorney, Agent, or Firm*—S. M. Mitchell; M. J. Meltzer; A. W. Karambelas

[57] ABSTRACT

A reconfigurable beam antenna system (12) comprises focusing means, a plurality of antenna elements (A, B, C, and D), a feed network (14), and a variable beam controlling means (16). The focusing means has a reflecting surface (18) which is adapted to reflect a plurality of electromagnetic energy signals. The feed network (14) comprises a plurality of feed ports (I1, I2, I3, and I4), a first plurality of hybrid couplers (30 and 32) connected to the feed ports, a plurality of phase shifters (34 and 36) connected to the first plurality of hybrid couplers, a second plurality of hybrid couplers 38 and 40 connected to both the first plurality of hybrid couplers and the phase shifters, and a plurality of antenna ports (01, 02, 03 and 04) connected to both the second plurality of hybrid couplers and the antenna elements (A, B, C, and D). The variable beam controlling means comprises a variable phase shifter (50) connected to one of the feed ports, a variable power coupler (60) connected to both another feed port and the variable phase shifter, and a plurality of channel network means (CH1, CH2, CH3 and CH4) connected to the variable power coupler.

6 Claims, 13 Drawing Sheets

$\Delta\phi = 0°$

Fig. 7.
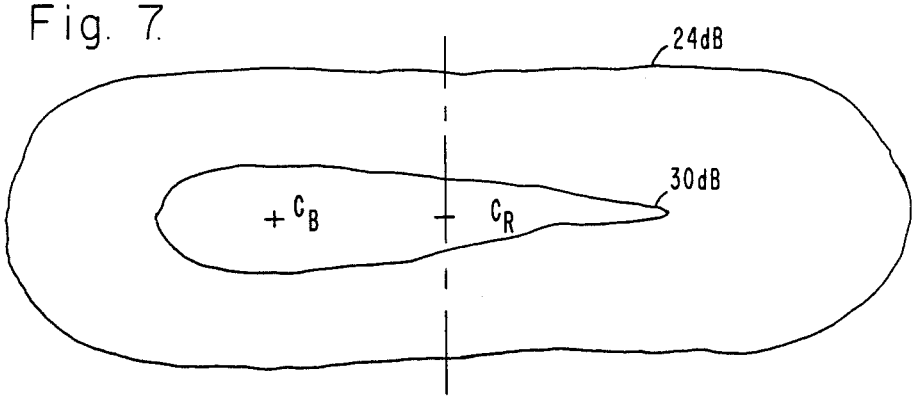
Fig. 8.
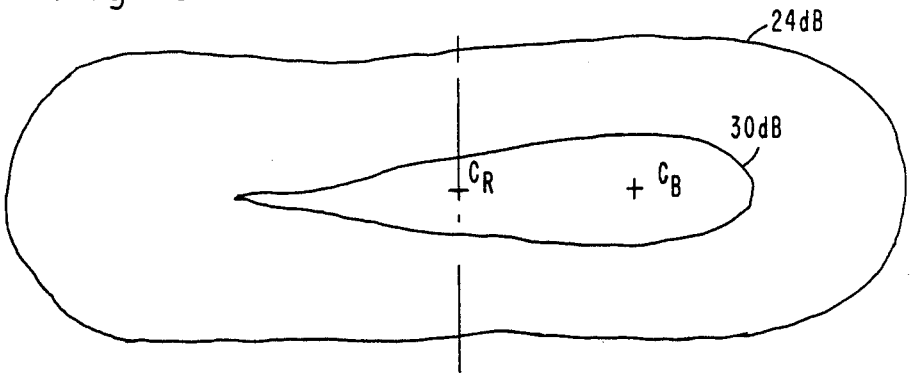
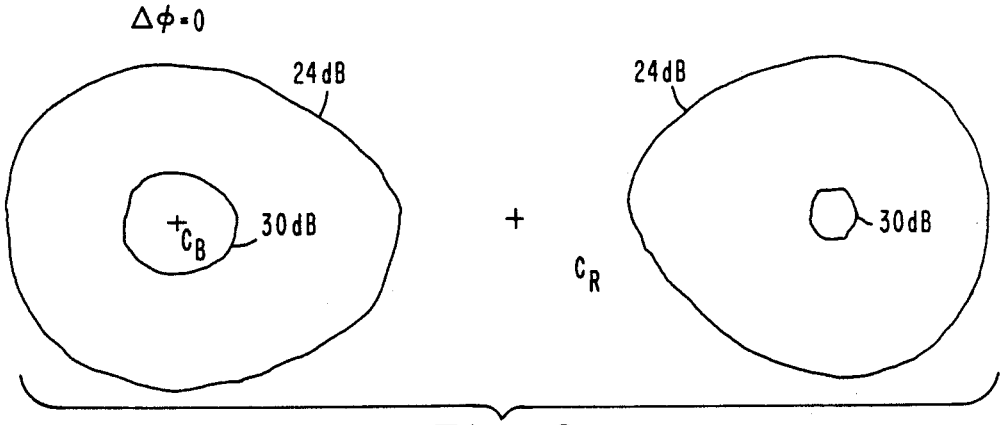
Fig. 9.

RECONFIGURABLE BEAM ANTENNA

REFERENCE TO PARENT APPLICATION

This is a continuation-in-part of application ser. No. 476,087 for RECONFIGURABLE BEAM ANTENNA filed Mar. 17, 1983, by James D. Thompson, and now abandoned.

TECHNICAL FIELD

This invention relates to antenna apparatus and, more particularly, to reconfigurable beam antennas.

BACKGROUND OF THE INVENTION

In satellite communication systems, electromagnetic energy signals are beamed from a satellite to the Earth. The beam of signals may cover either a large section of the Earth surface, such as a continent or a country, or a relatively small region. The first technique is generally referred to as area beam coverage and the latter technique is generally referred to as spot beam coverage. Moreover, simultaneous coverage by a plurality of spot beams may also be used. Such a technique is generally referred to as multiple beam coverage. The generation and positioning of such multiple beams is the subject of the present invention.

In general, multiple beam antenna systems are common in the prior art. For example, such systems are disclosed in U.S. Pat. Nos. 3,255,450, by Butler; 4,231,040, by Walker; and 4,315,262, by Acampora et al. More particularly, the multiple beam systems disclosed in both Butler and Walker, supra, are capable of transmitting simultaneously a multiplicity of individual signals. Acampora et al., supra, is capable of transmitting a plurality of spot beams each of which covers a region on the Earth. The prior art multiple beam systems cannot be changed readily from area beam coverage to spot beam coverage. Another deficiency in prior art multiple beam systems is the lack of convenient means for changing the spot beam coverage of a beam. A fortiori, the coverage of the individual signals cannot be changed independently. Another further deficiency in the prior art multiple beam systems is the absence of variable dual mode beam coverage. "Dual mode" in this regard is defined as two independent collections of signals. The collection of signals are generally referred to as "odd" and "even" modes.

SUMMARY OF THE INVENTION

In summary, the present invention provides a reconfigurable beam antenna system which comprises focusing means, a plurality of antenna elements, a feed network and variable beam controlling means. The feed network comprises a plurality of signal ports, a first plurality of hybrid couplers which are connected to the signal ports, a plurality of phase shifters which are in turn connected to the first plurality of hybrid couplers, a second plurality of hybrid couplers which are connected to both the first plurality of hybrid couplers and the phase shifters, and a plurality of antenna ports which are connected to both the second plurality of hybrid couplers and the plurality of antenna elements.

The variable controlling means includes a variable phase shifter connected to one signal port and a variable power coupler connected to both another signal port and the variable phase shifter. Channel network means are connected to said variable power coupler.

It is a purpose and advantage of the present invention to provide a novel reconfigurable beam antenna capable of readily changing from area beam coverage to spot beam coverage. Another purpose and advantage of the present invention is that the novel reconfigurable beam antenna is capable of permitting a signal to individually change its spot beam coverage. A further purpose and advantage of the present invention is that the novel reconfigurable beam antenna is capable of permitting a signal to independently change its spot beam coverage. Another further purpose and advantage of the present invention is that the novel reconfigurable beam antenna is capable of providing variable dual mode beam coverage.

Other purposes, features, and advantages of the present invention are apparent from the following detailed description of the preferred embodiments thereof, taken together with the accompanying drawings.

BRIEF DESCRIPTION OF THE DRAWINGS

FIG. 7 is an enlarged antenna beam pattern produced by the antenna of FIG. 6, depicting a full odd-mode beam.

FIG. 8 is an enlarged antenna beam pattern produced by the antenna of FIG. 6, depicting a full even-mode beam.

FIG. 9 is an enlarged antenna beam pattern produced by the antenna of FIG. 6, depicting bifurcated beams.

DETAILED DESCRIPTION OF THE INVENTION

The invention provides for receiving, transmitting and repeater applications. In the receiver aspect of the invention, the coverage of the antenna provides for spot or area selectivity. In this aspect, the variable power coupler is a variable power combiner, the antenna ports are input ports and the signal ports are output ports. In the detailed description of the embodiments below, the transmitting aspect of the invention is emphasized. The invention provides for spot or area directivity. In this aspect, the variable power couplers are variable power dividers, the signal ports are input ports and the antenna ports are output ports. The repeater application involves combining the transmitting and receiving aspects of the present invention.

In one embodiment of the present invention, the variable beam controlling means comprises a variable phase shifter which is connected to one of the signal ports, a variable power coupler which is connected to another of the signal ports and also connected to the variable phase shifter, and a plurality of channel network means which is connected to the variable power coupler. Thus, the variable controlling means is able to vary the size and location of one beam which contains a plurality of electromagnetic energy signals.

In a second embodiment of the present invention, the variable beam controlling means comprises a plurality of channel network means which are connected to the plurality of signal ports. Each of the plurality of channel network means has two channel outputs. The corresponding outputs of one of the channel outputs are connected to one of the plurality of signal ports. Similarly, the corresponding outputs of the other channel outputs are connected to another of the plurality of signal ports. Thus, the variable controlling means is able to vary the size and location of a plurality of beams each of which contains a separate electromagnetic energy signal.

In a third embodiment of the present invention, the variable beam controlling means comprises a plurality of channel network means which are connected to the plurality of signal ports. Each of the plurality of channel network means has two channel outputs, whereby the corresponding channel outputs of two adjacent channel network means are connected to one of the plurality of signal ports. Thus, the variable beam controlling means varies the size and location of a plurality of beams each of which contains a separate dual mode electromagnetic energy signal.

Figure 1:
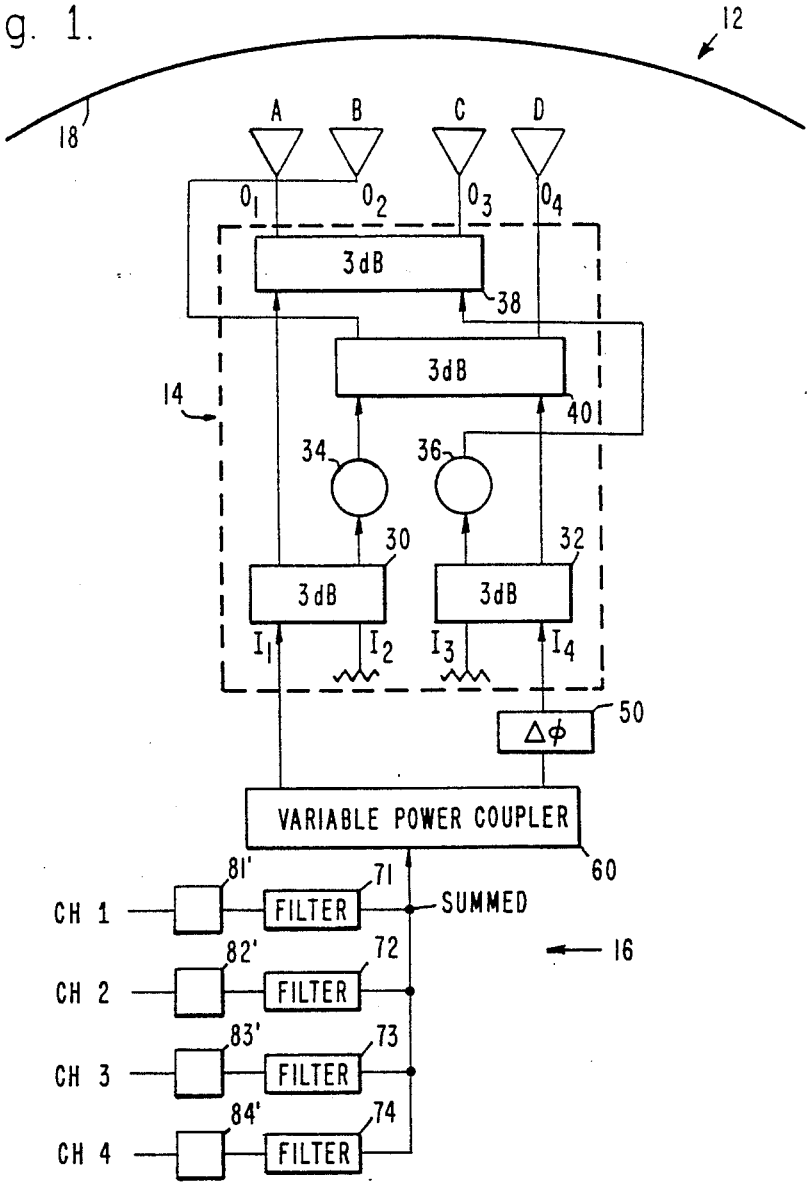
FIG. 1 is a schematic diagram of a reconfigurable beam antenna in accordance with the present invention.

Referring to FIG. 1, there is shown a reconfigurable beam antenna system, generally designated 12, in accordance with the present invention. Reconfigurable beam antenna system 12 in one aspect of the present invention is generally referred to as a one-mode variable beam type. System 12 comprises focusing means, a plurality of antenna elements, a feed network 14, and a variable beam controlling means 16.

More particularly, the focusing means has a reflecting surface 18, which is adapted to reflect a beam of electromagnetic energy signals. Reflecting surface 18, in the example, is an offset parabolic reflector with a diameter of 72 inches and a focal length of 60 inches. In addition, the plurality of antenna elements is a linear array of four feed horns, generally designated A, B, C, and D. The feed horns are arrayed in the azimuth plane. As an example, each of the feed horns, which illuminate the reflecting surface 18, has a horizontal width of 3 inches in order to provide adequate component beam overlap at the operating frequency of 3.95 Ghz.

Feed network 14 is connected to the array of antenna elements. As an example, feed network 14 is a four-port Butler matrix. (The principles of operation of a Butler matrix are well known to those skilled in the art. For example, see U.S. Pat. No. 3,255,450 issued to J. L. Butler on June 7, 1966 which is incorporated herein by this reference.) The Butler matrix 14 comprises a plurality of input ports I1 through I4, a first plurality of hybrid couplers 30 and 32 which are connected to the input ports and a plurality of phase shifters 34 and 36 which are connected to hybrid couplers 30 and 32. Phase shifters 34 and 36 shift and couple one output of couplers 30 and 32 to couplers 40 and 38 respectively. Thus, coupler 30 and phase shifter 36 provide two inputs to the coupler 38 as phase shifter 34 and coupler 32 provides the inputs to the coupler 40. A plurality of output ports 01 through 04 are connected to both hybrid couplers 38 and 40 and the plurality of antenna elements A through D. That is, output ports 01 and 03 are connected to the first and second outputs of the coupler 38 and output ports 02 and 04 are connected to the first and second outputs of coupler 40.

Couplers 30, 32, 38 and 40, in the example, are 3 dB hybrids each of which is adapted to provide a relative phase shift at the output ports of 90 degrees and to divide the power of a signal equally. Phase shifters 34 and 36 are adapted to shift a signal by 45 degrees. When each of the Butler matrix input ports is excited individually, that is, a signal is provided, the power at each of the output ports is equal.

In accordance with the present invention, variable beam controlling means 16 comprises: a variable phase shifter 50, which is connected to one of the Butler matrix input ports; a variable power divider 60, which is connected to both variable phase shifter 50 and another of the Butler matrix input ports; and a plurality of channel network means which are connected to variable power divider 60. Variable phase shifters and variable power couplers are known in the art. Each channel network means includes a multiplexer filter 71, 72, 73 or 74 and an amplifier 81', 82', 83' or 84'.

The outputs of the channel network means are summed at the input of variable power divider 60. Variable power divider 60 is adapted to vary the power routed to the input ports of the Butler matrix 14. In the example, the outputs of variable power divider 60 are connected to Butler matrix input port I1 and to variable phase shifter 50. Variable phase shifter 50, in turn, is connected to Butler matrix input port I4. Input ports I2 and I3 are terminated in this embodiment.

Figure 2:
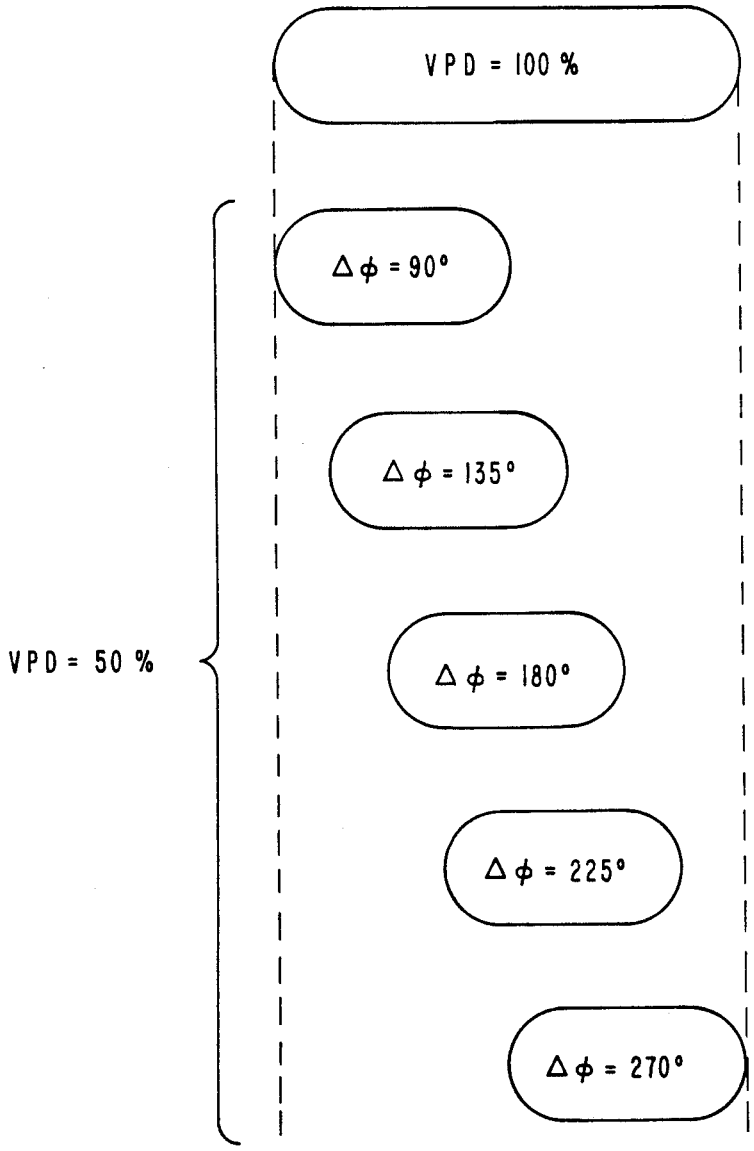
FIG. 2 illustrates antenna beam patterns produced by the antenna of FIG. 1, depicting variable beam sizes and locations.

In operation, the input signals entering at channel network means CH 1 through CH 4 are signals of different frequencies. The signals at the outputs of filters 71 through 74 are summed and then routed to variable power divider 60. However, the antenna beam radiation patterns produced by system 12 are dependent on the values selected for variable power divider 60 and variable phase shifter 50, as best shown in FIG. 2. For example, when the variable power divider 60 is set at 100%, all of the energy in the input signal is associated with a first signal at the first output of the variable power coupler 60. This first signal is routed to the input port I1. As there is no energy at the second output of the variable power coupler 60, there is no energy in what would otherwise be the second signal. There is therefore no input to the variable phase shifter 50. Thus, the variable phase shifter 50 has no output and the coupler 32 has no input. Accordingly, there is no output from the phase shifter 36 and no second input to either the power coupler 38 or the power coupler 40.

Coupler 30 divides the first signal into third and fourth signals of substantially equal power. The phase of the third signal substantially equals the phase of the first signal and the phase of the fourth signal is offset from the phase of the input signal by approximately 90 degrees. The third signal is provided to a first input port of coupler 38. The fourth signal is input to the phase shifter 34 which applies a −45 degree phase shift. Thus, the signal output from the phase shifter 34 is offset in phase by 45 degrees relative to the third signal. The output of the phase shifter 34 is a first and, in this 100% power coupler 60 setting case, only input to power coupler 40.

The coupler 38 divides the third signal at its first input port into fifth and sixth signals of substantially equal power levels with a 90 degree relative phase shift. That is, the fifth signal appears at the output port 01, with no phase shift, and the sixth signal appears at the second output of the coupler 38 at 03, with a 90 degree phase shift relative to the combined signals input at I1.

Similarly, the signal input to the first input port of the power coupler 40, exits from the first and second output ports of the power coupler 40 as seventh and eighth signals having substantially equal power levels and a relative 90 degree phase shift. The seventh signal has a net 45 degree phase offset relative to the input signal and appears at output port 02. Similarly, the eighth signal appears at output port 04 with a net 135 degree phase shift.

Table I shows the phase distribution in degrees at the four output ports A, B, C and D for input separately to any one of the four input ports I1, I2, I3, or I4. When all of the input power is applied to input port I1, the distribution of output power at the four output ports is as shown in the first line of Table I. Note that input port Il provides a +45 degree phase progression from feed horn to feed horn, while input port I4 provides a −45 degree phase progression.

TABLE I

| | A | B | C | D |
|---|---|---|---|---|
| I1 | 0 | 45 | 90 | 135 |
| I2 | 90 | −45 | 180 | 45 |
| I3 | 45 | 180 | −45 | 90 |
| I4 | 135 | 90 | 45 | 0 |

Figure 3:
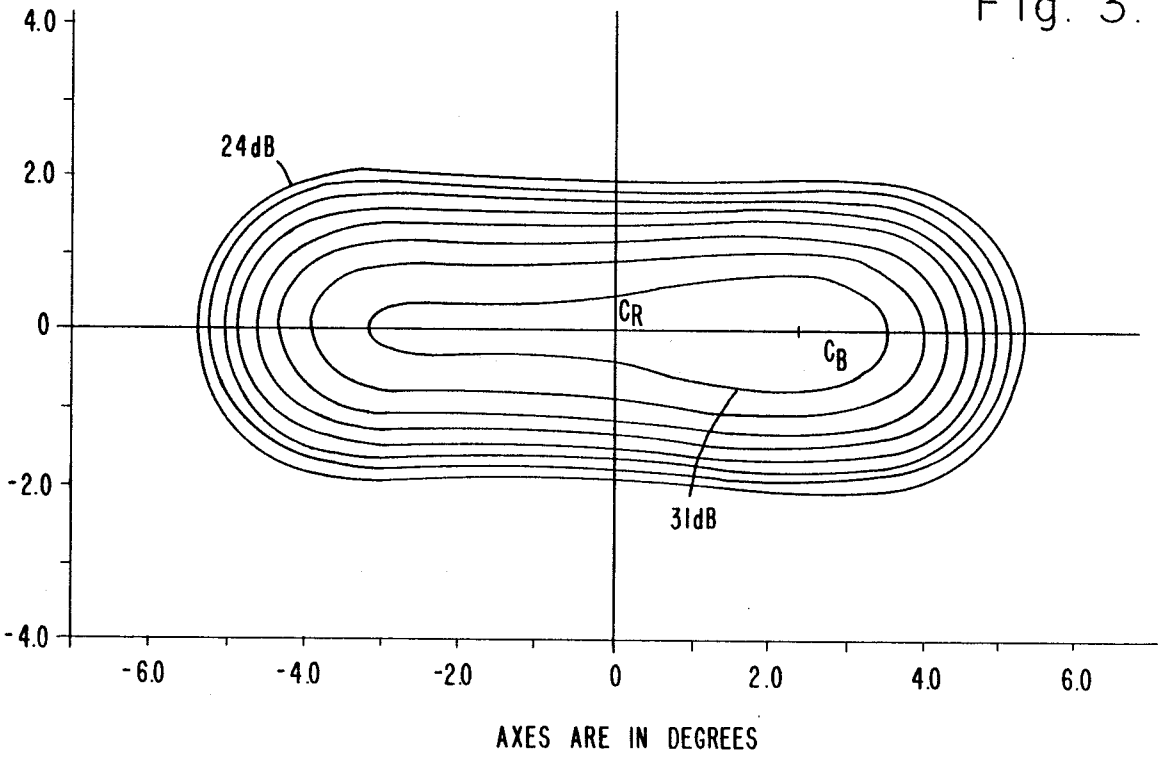
FIG. 3 is an enlarged antenna beam pattern produced by the antenna of FIG. 1, depicting full beam coverage.
Figure 4A:
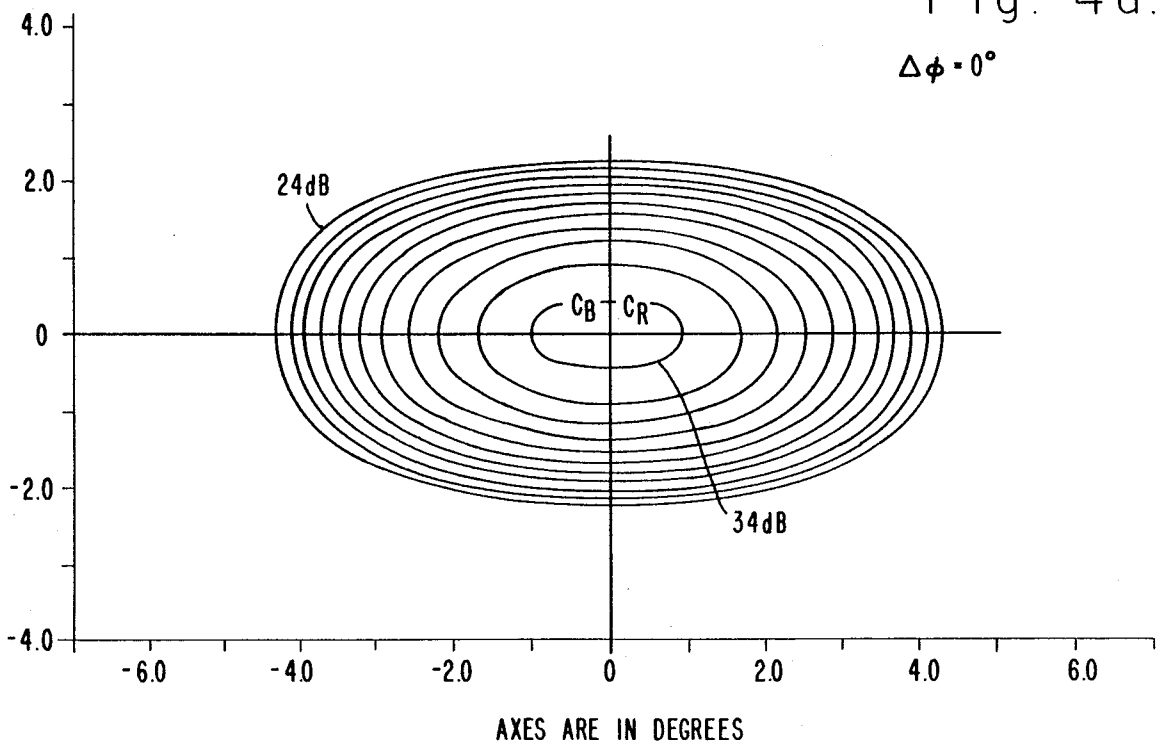
FIGS. 4*a* through 4*e* are enlarged antenna beam patterns produced by the antenna of FIG. 1, depicting a movable beam which is incrementally changing the $\Delta\phi$ from 0° to 180°.
Figure 4B:
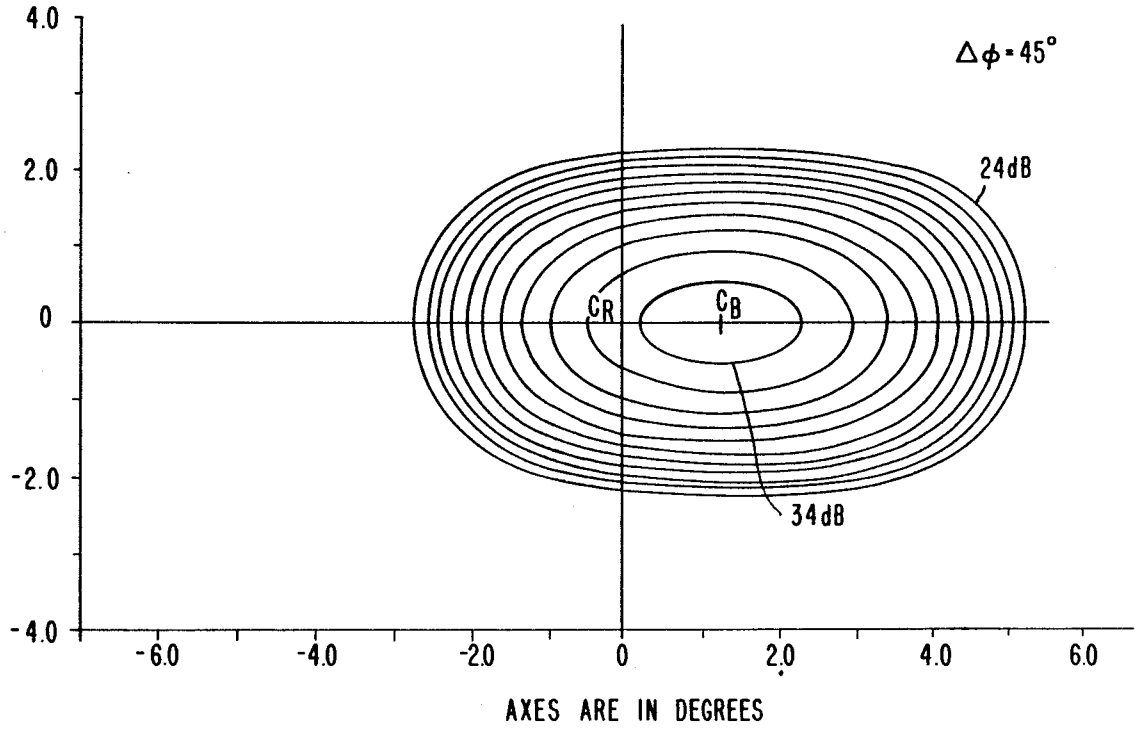
Figure 4C:
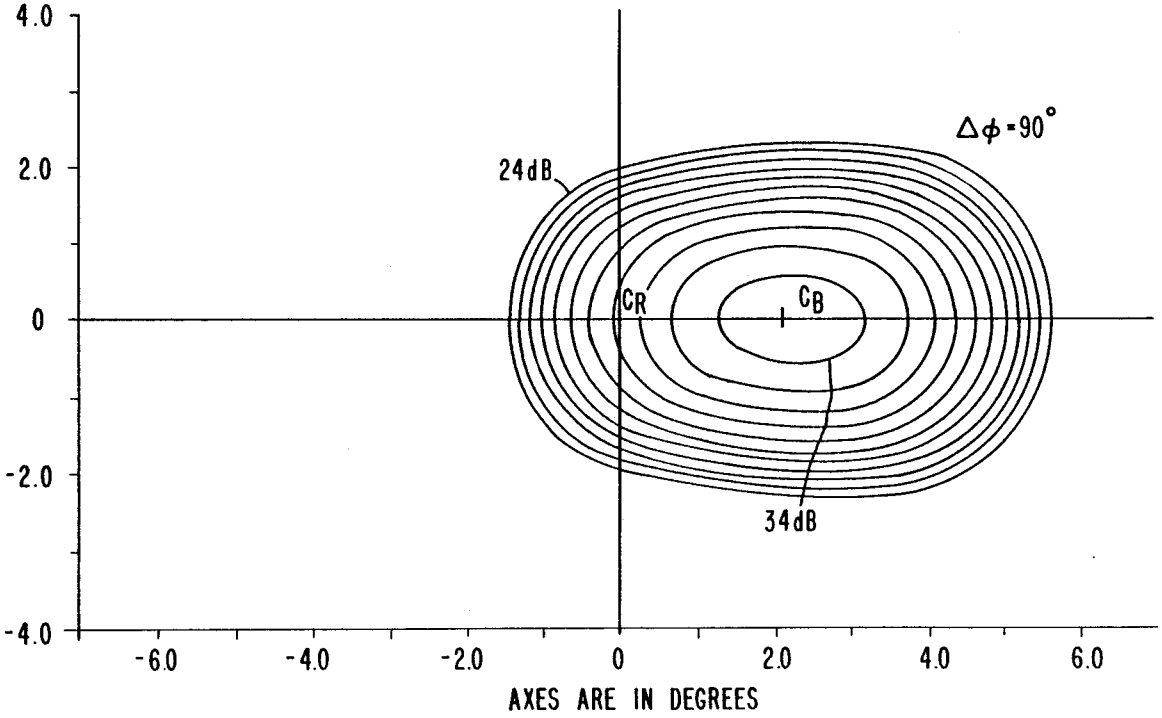
Figure 4D:
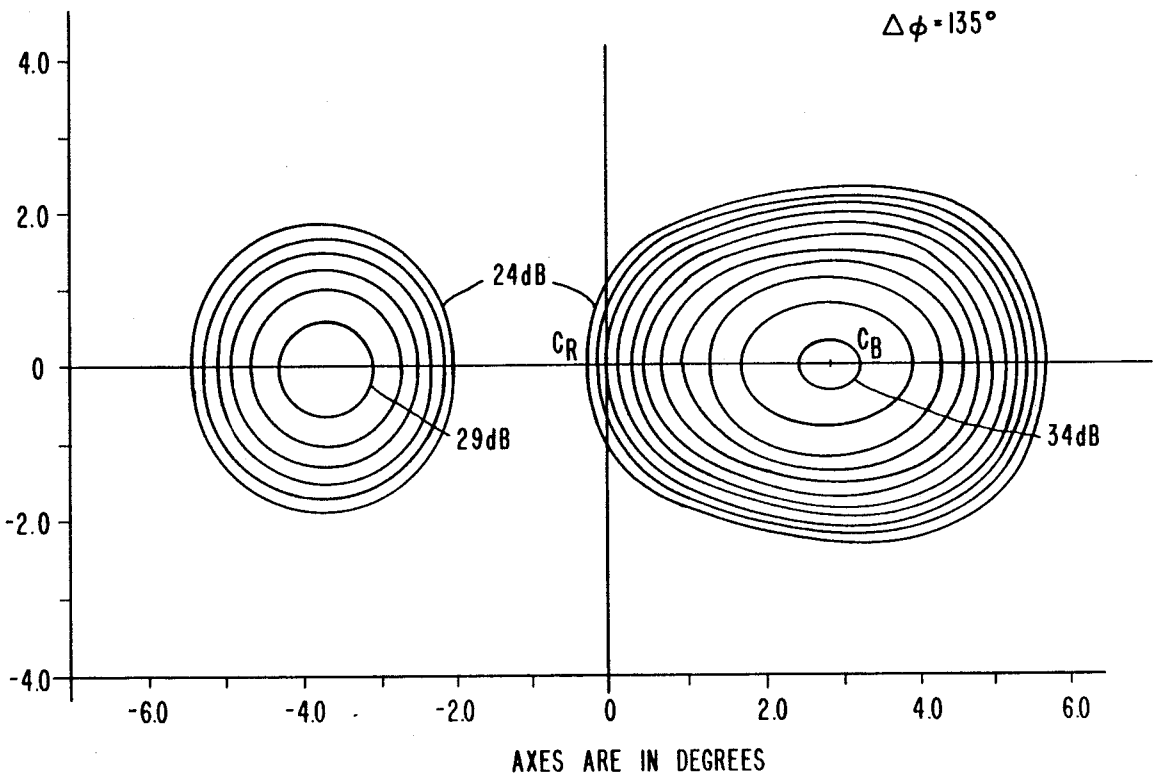
Figure 4E:
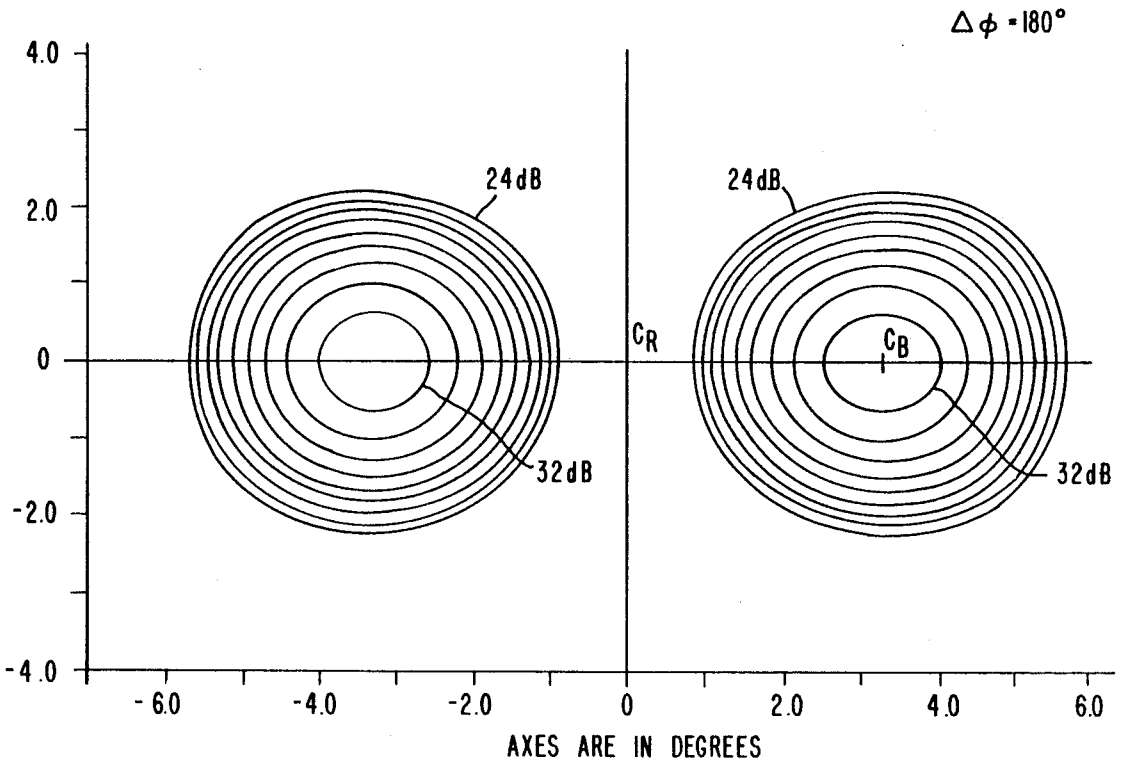

The antenna radiation beam pattern corresponding to a power divider setting of 100% is illustrated by the topmost pattern in FIG. 2. This radiation pattern is analogous to area beam coverage of a continent or a country. In this example, at most four different signals are available to this area. The radiation pattern of FIG. 2 is illustrated in greater detail in FIG. 3. The peak antenna gain is indicated at CB is shown relative to a reference point CR, which might be a fixed point on the earth's surface. The innermost contour line indicates the gain having an integer value and the outermost contour line represents a 24 dB antenna gain. The same conventions apply to beam pattern FIGS. 4(*a–e*), 7, 8, 9, and 10(*a–g*). The intermediate contour lines in FIGS. 3 and 4(*a–e*) indicate 1 dB increments.

Next, by selecting the value of variable power divider 60 to be other than 100% and by varying the value of variable phase shifter 50, the resultant antenna beam radiation patterns vary, as best shown in FIG. 2. When variable power divider 60 is set at 50%, equal energy is entering Butler matrix input port I1 and input port I4. As variable phase shifter 50 changes its phase within a range of −180° to 180°, the power exiting at each of he feed horns varies accordingly. Moreover, the phase of the signal exiting each of the feed horns also changes. A compilation of the data for the phase change $\Delta\phi$ of variable phase shifter 50 and the resultant amplitude and phase at each of the feed horns is stated in the following Table II.

The first column of Table II shows the setting $\Delta\phi$ of phase shifter 20 in degrees. With the power divider 60 set at 50%, the fractional power (e.g. PA) and phase (i.e. $\phi$A in degrees) for each port are shown across the lines.

For Table II, the power at each horn is calculated as such:

TABLE II

| $\Delta\phi$ | PA | $\phi$A | PB | $\phi$B | PC | $\phi$C | PD | $\phi$D |
|---|---|---|---|---|---|---|---|---|
| −180 | .42 | −22.5 | .07 | −22.5 | .07 | 157.5 | .42 | 157.5 |
| −135 | .5 | 0 | .25 | 0 | 0 | — | .25 | 180 |
| −90 | .42 | 22.5 | .42 | 22.5 | .07 | 22.5 | .07 | 202.5 |
| −45 | .25 | 45 | .5 | 45 | .25 | 45 | 0 | — |
| 0 | .07 | 67.5 | .42 | 67.5 | .42 | 67.5 | .07 | 67.5 |
| 45 | 0 | — | .25 | 90 | .5 | 90 | .25 | 90 |
| 90 | .07 | −67.5 | .07 | 112.5 | .42 | 112.5 | .42 | 112.5 |
| 135 | .25 | −45 | 0 | — | .25 | 135 | .5 | 135 |
| 180 | .42 | −22.5 | .07 | −22.5 | .07 | 157.5 | .42 | 157.5 |

$PA = \frac{1}{2}\cos^2((\phi + 45)/2)$
$PB = \frac{1}{2}\cos^2((\phi + 135)/2)$
$PC = \frac{1}{2}\cos^2((\phi - 135)/2)$
$PD = \frac{1}{2}\cos^2((\phi - 45)/2)$ As shown in FIG. 2, the resultant antenna beam pattern scans rightwardly as variable phase shifter 50 changes its $\Delta\phi$ from 90° to 270°. Moreover, FIGS. 4*a–4e* illustrate another set of enlarged antenna beam radiation patterns as $\Delta\phi$ changes from 0° to 180°. Note the rightward movement of the beam center CB with respect to the reference point CR. This scanning capability is analogous to multiple spot beam coverage in which a spot beam covers a region of Earth such as a time zone or a particular state or province. Again, system 12 produces at most four different signals within each spot beam. The phase shift changes, thus, reconfigure the sizes and locations of the antenna beam radiation patterns each of which contains all the different signals. In addition, the shape of the antenna beam radiation pattern may be reconfigured. The oblong, horizontal patterns of FIGS. 2, 3, and 4*a–4e* are the result of the linear, horizontal orientation of antenna elements A, B, C and D. Alternative variations of phase and power distributions permit electronic control of beam shape as well as position. Other arrangements of antenna elements would produce radiation patterns of different shapes.

Figure 5:
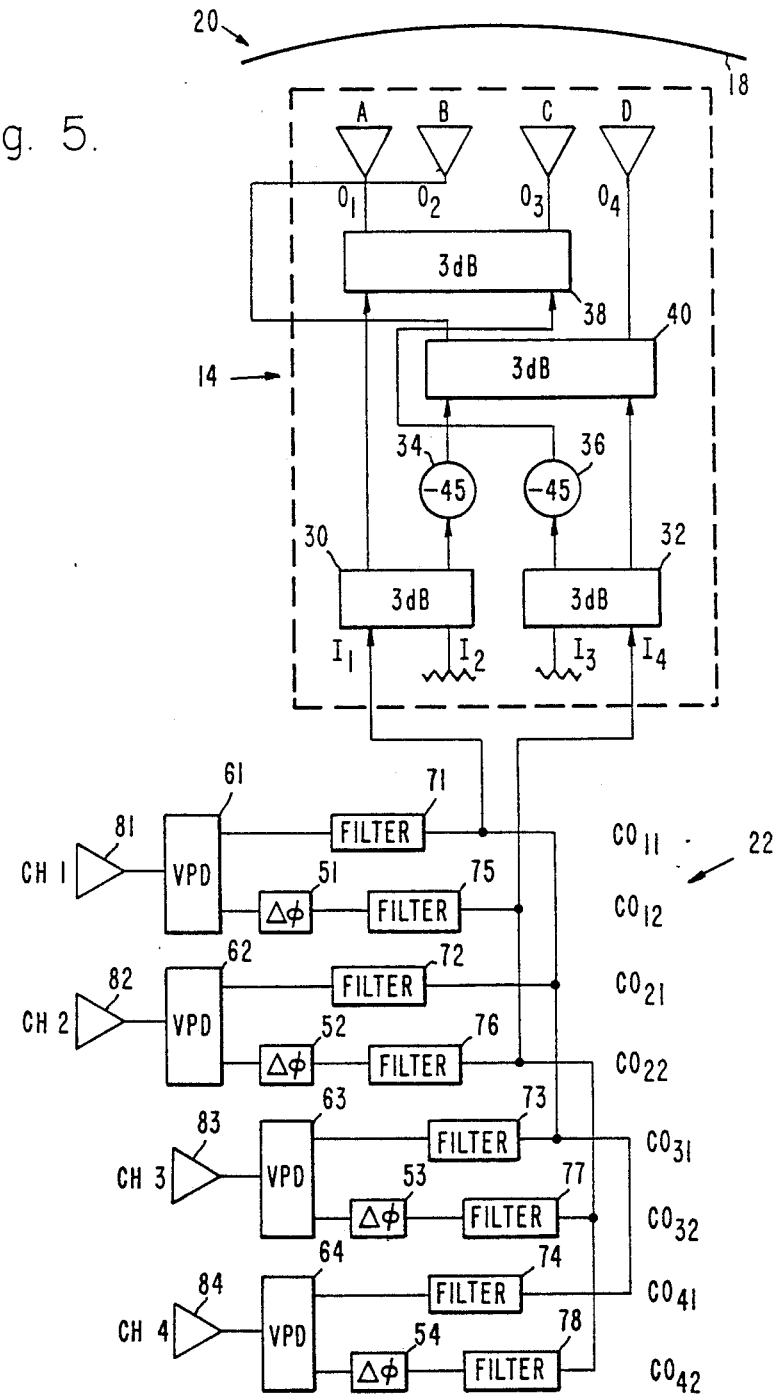
FIG. 5 is a schematic diagram of a second reconfigurable beam antenna in accordance with the present invention.

Referring to FIG. 5, there is shown the second embodiment of the present invention. Reconfigurable beam antenna system 20 is generally referred to as a one-mode variable beam per channel type. In this example, only variable beam controlling means 22 is different from variable beam controlling means 16 of system 12.

More particular, variable beam controlling means 22 comprises a plurality of channel network means which are coupled to Butler matrix input ports I1 through I4. Each of the plurality of channel network means has two channel outputs. All of the corresponding outputs from one of the channel outputs are connected to one of the Butler matrix input ports. Similarly, all of the corresponding outputs from another of the channel outputs are connected to another Butler matrix input port. Since the channel network means are identical, only one channel network means will be described.

As an example, channel network means 1 includes two filters 71, 75 which are connected to the plurality of Butler matrix input ports. The two filters 71; 75 define the two channel outputs, generally designated COn1 and COn2,where n is an integer. For channel 1, where n is one, the channel outputs are CO11 and C012. In addition, a variable phase shifter 51 is connected to one of the filters 71, 75. A variable power divider 61 is connected to variable phase shifter 51 and the other of the filters 71, 75. Lastly, an amplifier 81 is connected to variable power divider 61. The output of filter 71, CO11 is connected to Butler matrix input port I1, and the output of filter 75, C012, is connected to Butler matrix input port I4. Input ports I2 and I3 are also grounded. The outputs of the filters corresponding to filter 71, that is filters 72, 73 and 74, are summed at input port I1; and outputs of the filters corresponding to filters 75, 76, 77, and 78 are summed at input port I4.

In operation, variable beam controlling means 22 provides two paths to feed network 14 with variable phase control in one path. In the example shown in FIG. 5, a part of a signal is routed via input port I1, and another part is routed to the feed horns via a phase shifter and input port I4. Each of the Butler matrix input ports is associated with a set of output amplitude and phase values at the output ports. Subsequently, the two parts of each signal are vectorially recombined to form the resultant feed distribution. The variable phase shifter in each channel is provided to change the phase distribution that is routed via input port I4. The variable phase control, thus, is able to change the position of the antenna radiation pattern by altering the vector summation of the resultant excitation. By setting various phases in variable phase shifters 51, 52, 53 or 54, the location of the radiation pattern is varied.

For the example of FIG. 5, the relative phase of the feed network outputs for each input is also shown in Table I.

When all variable power dividers 61, 62, 63 and 64 are set at 100%, similar to the above-described aspect, all energy is routed to Butler matrix input port I1 to produce the topmost antenna radiation pattern as shown in FIG. 2. In this example, at most four different signals are available in this area beam coverage.

However, when the variable phase shifter in each channel network means changes its value, the resultant antenna beam radiation pattern varies its location, as again best shown in FIG. 2. The variable phase shifter in each channel network means advances or retards one set of excitations with respect to the other, thus, affecting the resulting feed excitation and the associated antenna beam radiation pattern. For example, if variable power divider 61 is set at 50% and variable phase shifter 51 is set at 90°, the resultant beam is at the $\Delta\phi=90°$ position of FIG. 2. Moreover, the resultant beam of other channels may occupy the same or different positions as their variable phase shifters vary. Thus, system 20 is able to simultaneously provide individual and independent spot beam coverages. Each spot beam, in this instance, contains one separate signal.

Figure 6:
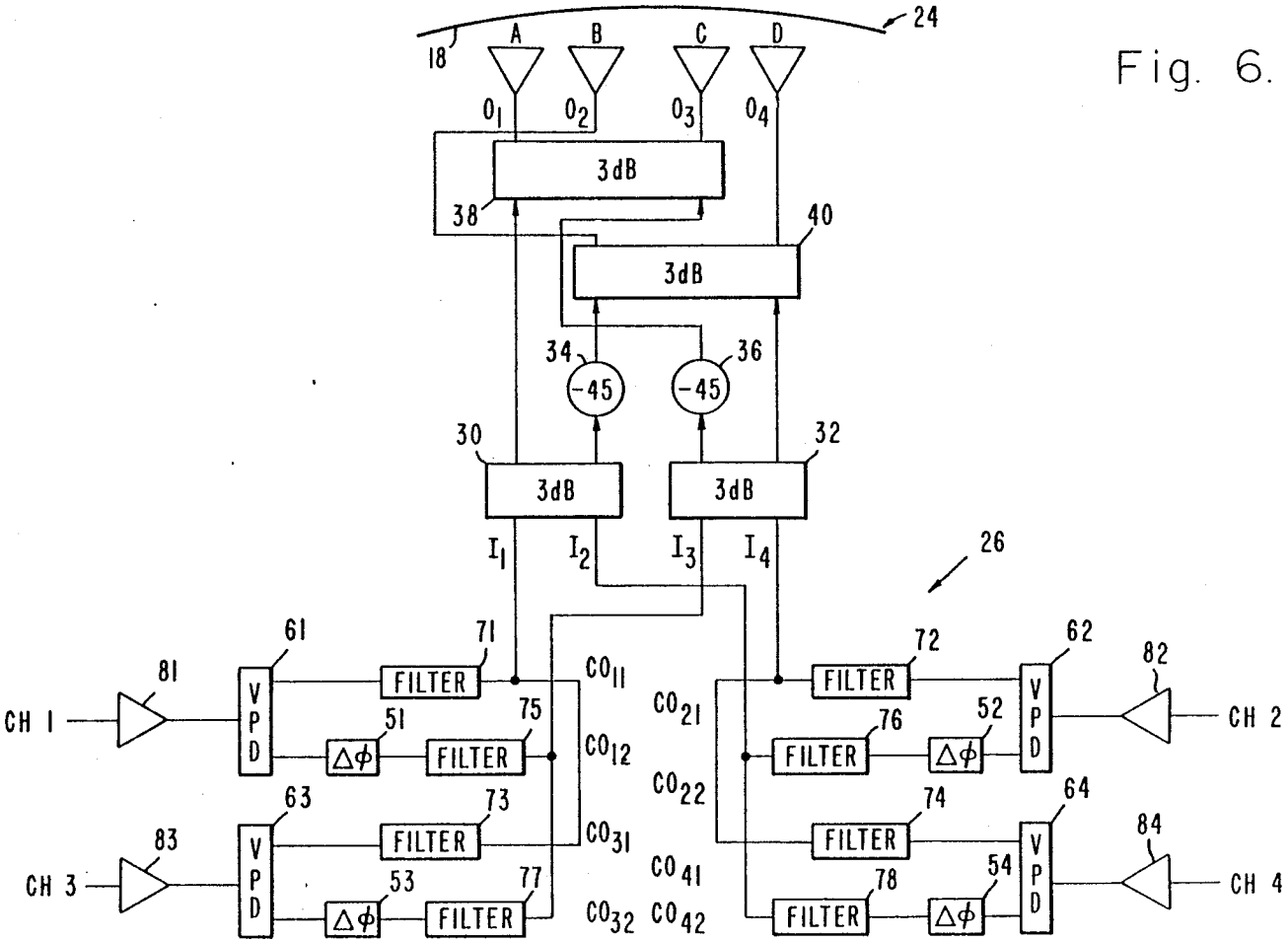
FIG. 6 is a schematic diagram of a third reconfigurable beam antenna in accordance with the present invention.
Figure 10A:
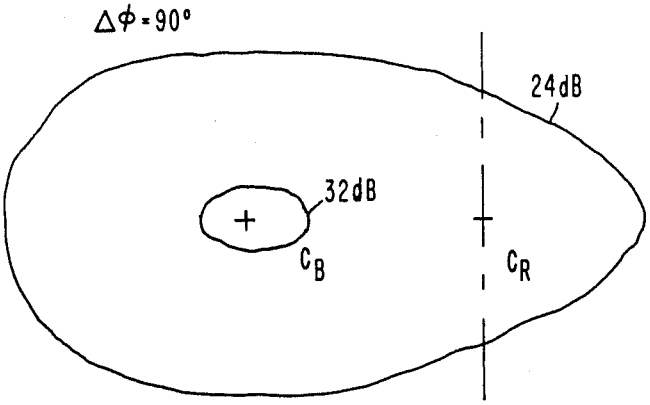
FIGS. 10*a* through 10*g* are enlarged antenna beam patterns produced by the antenna of FIG. 6, depicting a movable beam which is incrementally changing the $\Delta\phi$ from 90° to 180°.
Figure 10B:
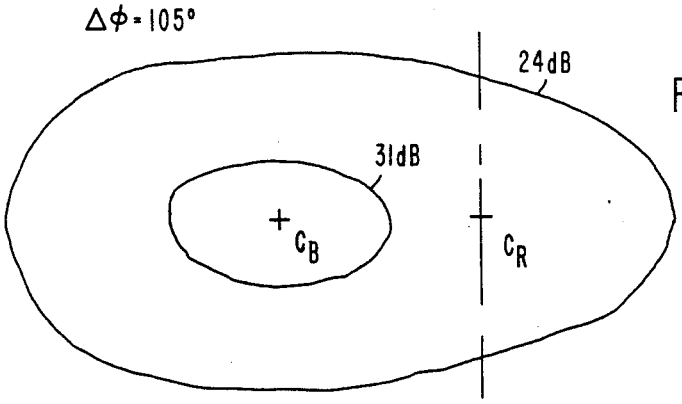
Figure 10C:
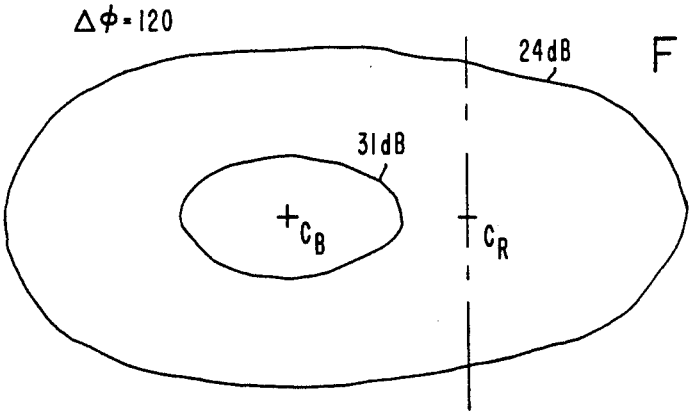
Figure 10E:
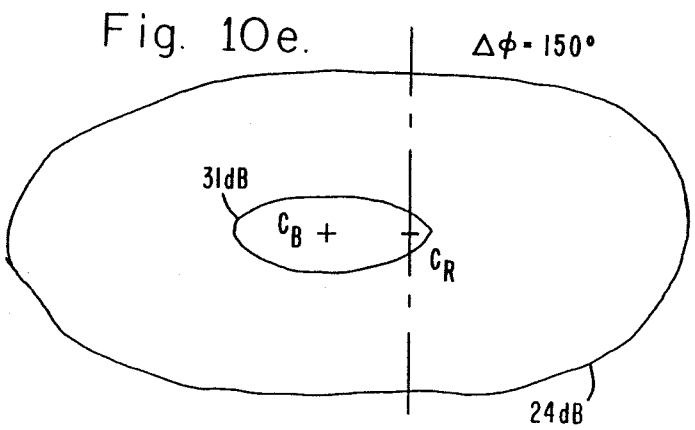
Figure 10D:
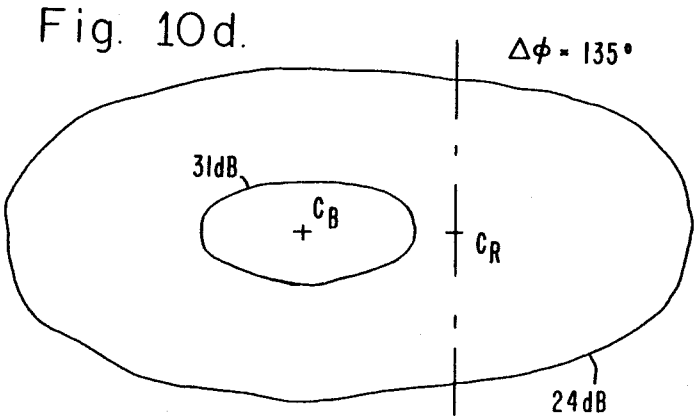
Figure 10G:
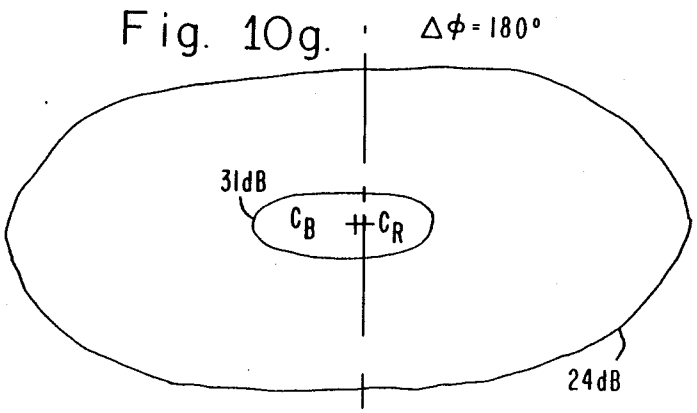
Figure 10F:
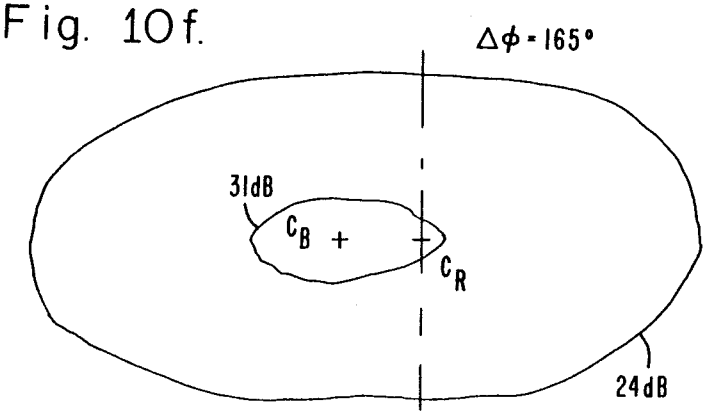

Referring to FIG. 6, there is shown the third embodiment of the present invention. Reconfigurable beam antenna system 24 is generally referred to as a dual mode variable beam per channel type. Again, only variable beam controlling means 26 is different from that of either system 12 or 20. In particular, system 24 differs from system 20 only in the way the outputs of the channel network means to the Butler matrix input ports are connected. Outputs of filters 71 and 73 are connected to input port I1; outputs of filters 75 and 77 are connected to input port I3; outputs of filters 76 and 78 are connected to input port I2; and outputs of filter 72 and 74 are connected to input port I4. "Dual mode" in this regard is defined as two independent collections of signals. The collection of signals are generally referred to as "odd" and "even" modes.

In order to realize a dual mode system with the same total coverage for odd and even channels, input ports I1 and I4 are excited by the odd and even channels, respectively; while ports I2 and I3 are not excited. Note that because of the inherent symmetry of Table I (input port I1 versus input port I4 and input port I3 versus input port I2), the odd and even channels will have similar characteristics.

To form the variable coverage beams, the variable power dividers are set to distribute power equally. With this arrangement, each odd channel routes half of its power to the feed horns via input port I1 and the other half to the horns via input port I3. These signals recombine by vector addition at each feed horn to form the resultant feed power distribution. Since variable phase control $\Delta\phi$ is provided in the second path for each channel such as C012 and C032, the relative phase of the component signal vectors at each horn can be varied and hence, the feed power distribution can be varied on a channel-by-channel basis. The calculated resultant feed power (amplitude and phase) distribution for the odd mode as a function of phase shift is shown in Table III. The setting of phase shifter 50 in degrees is shown as $\Delta\phi$. The fraction of the total power at each horn and the phase thereof is shown in the following pairs of columns.

TABLE III

| $\Delta\phi$ | PA | $\phi$A | PB | $\phi$B | PC | $\phi$C | PD | $\phi$D |
|---|---|---|---|---|---|---|---|---|
| 0 | .4268 | 22.5 | .0732 | 112.5 | .0732 | 22.5 | .4268 | 112.5 |
| 45 | .2500 | 45.0 | .0000 | — | .25 | 45 | .5000 | 135 |
| 90 | .0732 | 67.5 | .0732 | −22.5 | .4268 | 67.5 | .4268 | 152.5 |
| 135 | .0000 | — | .2500 | 0 | .5000 | 90 | .2500 | 180 |
| 180 | .0732 | −67.5 | .4268 | 22.5 | .4268 | 112.5 | .0732 | 202.5 |
| 225 | .2500 | −45.0 | .5000 | 45 | .2500 | 135 | .0000 | — |
| 270 | .4268 | −22.5 | .4268 | 67.5 | .0732 | 157.5 | .0732 | 67.5 |
| 315 | .5000 | 0.0 | .2500 | 90 | .0000 | — | .2500 | 90 |
| 360 | .4268 | 22.5 | .0732 | 112.5 | .0732 | 22.5 | .4268 | 112.5 |

At the $\Delta\phi=90°$, most of the power is concentrated in feed horns C and D. As $\Delta\phi$ is increased, the power shifts from right to left across the feed array when the horns are collinear.

To form the full dual mode beam, the odd and even channel variable power dividers route all power to input ports I1 and I4, respectively. The resultant beam pattern is again the topmost pattern of FIG. 2. The full dual mode antenna patterns for the odd mode and the even mode are shown in FIGS. 7 and 8, respectively. For the odd mode of FIG. 7, variable power dividers 61 and 63 are at 100%, that is all the energy is routed to input port I1 and none to input port I3. Similarly, variable power dividers 62 and 64 are set at 100% for the even mode of FIG. 8 so that all energy is routed to input port I4 and none to input port I2. In this example, at most four different signals of the same mode are available in each area beam coverage. In addition, odd and even mode antenna beam patterns occupy the same location simultaneously.

Further, FIG. 9 illustrates a bifurcated full dual mode pattern for either mode with all variable power dividers at 50% and all variable phase shifters at 0°. Moreover, FIGS. 10*a* through 10*g* illustrate a movable beam of either mode as it scans over half its available range, corresponding to values of $\Delta\phi$ ranging from 90° degrees to 180° degrees in 45 degree increments. Again, note the rightward movement of the beam center CB with respect to a reference point CR. An odd mode pattern and an even mode pattern occupy the same location simultaneously. Thus, system 24 is able to provide individual and independent dual mode spot beam coverages simultaneously. Each spot beam of one mode, in this instance, contains one signal of that mode.

It will be apparent to those skilled in the art that various modifications may be made within the spirit of the invention and the scope of the appended claims. As indicated above, the present invention has transmitting, receiving and repeater applications. For example, the concept is applicable to any number of feed horns greater than or equal to two, or any multiple of two for dual mode operation. Similarly, any $n \times n$ feed network may be used, where n is an integer. This may be accomplished by having the vector field associated with a given input port be orthogonal to the vector field associated with any other input port. The present invention can provide for adjustment of a beam in both the azimuth and elevation planes, for example, by providing a two-dimensional arrangement of the antenna elements and an appropriate feed network. Furthermore, the invention offers a high degree of control over beam shape as well as beam position. Moreover, a two-dimensional element array offers beam shaping as well as positioning in both the azimuth and elevation planes. In addition, the focusing means may be a lens or an alternate type of reflector surface. Further, the reconfigurable beam antenna systems may be operated for either signal transmission or signal reception.

What is claimed is:

1. A reconfigurable beam antenna comprising:

input means for providing a plurality of input signals;

variable power coupling means operatively connected to said input means and having first and second output ports for selectively dividing said input signals into first and second signals at said first and second output ports respectively;

variable phase shifting means operatively connected to said second output port of said variable power divider for selectively shifting the phase of said second signal; and feed network means for distributing said first signal and said phase shifted second signal between a plurality of antenna feeds.

2. The reconfigurable beam antenna of claim 1 including filter means for filtering said first signal and said phase shifted second signal.

3. The reconfigurable beam antenna of claim 1 wherein said variable power divider is continuously variable.

4. The reconfigurable beam antenna of claim 1 wherein said variable phase shifter is continuously variable.

5. The reconfigurable beam antenna of claim 1 wherein said feed network is a Butler matrix feed network.

6. A continuously steerable, continuously reconfigurable beam antenna comprising:

input means for providing a plurality of input signals;

continuously variable power coupling means operatively connected to said input means and having first and second output ports for selectively dividing said first and second input signals into first and second signals at said first and second output ports respectively;

continuously variable phase shifting means operatively connected to said second output port of said variable power divider for selectively shifting the phase of said second signal; and feed network means for distributing said first signal and said phase shifted second signal between a plurality of antenna feeds.

* * * * *